United States Patent [19]

Karoubas

[11] Patent Number: 4,675,238

[45] **Date of Patent: * Jun. 23, 1987**

[54] METAL DECKING

[75] Inventor: Konstantinos I. Karoubas, Hull, Mass.

[73] Assignee: Roll Form Products, Inc., Boston, Mass.

[ * ] Notice: The portion of the term of this patent subsequent to Apr. 1, 2003 has been disclaimed.

[21] Appl. No.: 816,395

[22] Filed: Jan. 6, 1986

Related U.S. Application Data

[63] Continuation of Ser. No. 617,671, Jun. 6, 1984, Pat. No. 4,579,785.

[51] Int. Cl.[4] ..... E04C 2/32; E04C 5/03

[52] U.S. Cl. ..... 428/599; 428/603; 52/450; 52/334

[58] Field of Search ..... 428/593, 594, 596, 599, 428/603, 604; 52/334, 336, 447, 450, 630, 537, 177, 196

[56] References Cited

U.S. PATENT DOCUMENTS

| | | | |
|---|---|---|---|
| 31,068 | 6/1861 | Vernam | 428/604 |
| 2,160,677 | 5/1939 | Romanoff | 428/603 |
| 2,329,789 | 9/1943 | Schank et al. | 428/603 |
| 2,526,323 | 10/1950 | Blaski | 52/630 |
| 3,059,733 | 10/1962 | Hermann | 52/630 |
| 3,111,788 | 11/1963 | Ouellet | 52/537 |
| 3,397,497 | 8/1968 | Shea et al. | 52/334 |
| 3,421,279 | 1/1969 | Franc | 428/603 |
| 3,812,636 | 5/1974 | Albrecht et al. | 52/334 |
| 4,074,495 | 2/1978 | Bodnar | 52/630 |
| 4,125,977 | 11/1978 | Michlovic | 52/334 |
| 4,144,369 | 3/1979 | Wass | 52/334 |
| 4,453,364 | 6/1984 | Ting | 52/630 |

FOREIGN PATENT DOCUMENTS

| | | | |
|---|---|---|---|
| 902383 | 6/1972 | Canada | 52/450 |
| 654780 | 3/1979 | U.S.S.R. | 52/450 |

OTHER PUBLICATIONS

Westwood and Baillies Specification No. 341, Jan. 29, 1875, Drawings only, 2 pages.

*Primary Examiner*—Melvyn J. Andrews
*Assistant Examiner*—John J. Zimmerman
*Attorney, Agent, or Firm*—Wolf, Greenfield & Sacks

[57] ABSTRACT

A corrugated metal decking having alternating crests and troughs and interconnecting therebetween a decking web that is characterized by improved stiffening means, in particular in the form of embossments or indentations. There are provided a plurality of linear indentations, each extending across the decking web between the crest and trough walls. These indentations include inner and outer formed indentations, formed symmetrically about the web center plane with the length of each indentation being in the range of 70%-90% of the web cross-dimension and with the indentations being closely spaced. This arrangement provides for superior web stiffening and also provides improved composite action for interlocking between the metal decking and the concrete.

28 Claims, 5 Drawing Figures

METAL DECKING

This application is a continuation of application serial no. 06/617,671, filed 6-6-84, now U.S. Pat. No. 4,579,785.

BACKGROUND OF THE INVENTION

The present invention related in general to corrugated metal decking, and pertains, more particularly, to a corrugated metal decking having improved means for web stiffening. Even more particularly, the present invention relates to an improved corrugated metal decking characterized by improved web stiffening to prevent web buckling and also characterized by improved composite action between the metal and concrete after the concrete has been poured over the decking.

After corrugated metal decking has been disposed in position during the construction of a building, for example, the metal decking may experience relatively high loads and associated abuse brought about by construction workers, construction material, or construction equipment. Most deck failures occur during this construction phase. One of the most typical types of failure occurs due to the buckling of the web from high applied and concentrated loads. By way of example, these loads may be from wheel buggies, or from a large quantity of concrete being placed in one location of the decking. In the prior art there exist structures that employ web stiffening. However, most of these structures do not provide for an optimization of web stiffening and in fact many of the prior attempts at strengthening the web of the corrugated metal decking actually instead tend to weaken the web. For example, embossments or indentations that tend to extend lengthwise of the web many times create further problems and actually enhance the buckling action under the load.

Accordingly, it is an object of the present invention to provide an improved means for stiffening the corrugated metal flooring and in particular for stiffening the web that comprises a part of the corrugated metal flooring.

Another object of the present invention is to provide for corrugated metal decking web stiffening by means of embossments or indentations that function as reinforcing columns strengthening the web and therefore strengthening the deck so as to prevent buckling of the web and associated buckling of the deck.

Still another object of the present invention is to provide an improved corrugated metal decking having improved web stiffening so that the decking is capable of carrying higher loads and is also capable of spanning greater lengths unshored.

Still a further object of the present invention is to provide an improved stiffened web for a corrugated metal flooring that not only prevents web buckling but also provides improved composite action between the decking and concrete that is poured over the decking.

SUMMARY OF THE INVENTION

To accomplish the foregoing and other objects features and advantages of the invention, there is provided an improved means for stiffening the web of a corrugated metal decking. The corrugated metal decking has alternating crests and troughs and has interconnecting therebetween a decking web which is usually disposed angularly out of the vertical. The web stiffening is provided by means of a plurality of linear indentations each extending across the web decking between the crest and trough walls. The crest and trough walls are typically horizontally disposed. The indentations or embossments are disposed in a parallel array with the length of each indentation preferably extending substantially the full height or full web cross-dimension of the interconnecting web. There is a radius provided between the crest and trough walls and the flat web and the indentations or embossments preferably do not extend into this radius but commence just after the radius turn and as indicated previously extends substantially from there the full height of the web. It has been found that the preferred length of each indentation is in the range of 70%–95% of the full web cross-dimension. Also, in a preferred embodiment of the invention the linear indentations or embossments are formed by an alternate forming technique in which the indentations are alternately formed to extend into and out of the plane of the web. The embossments or indentations actually serve a dual purpose. First, they stiffen the web thus preventing web crippling (buckling) during the construction phase. Second, the orientation and close spacing of the stiffening embossments or indentations provides for improved composite actions between the metal decking and the concrete after the concrete has been poured. In other words the embossments or indentation function as both a stiffener, thus strengthening the deck and as interlocking means, essentially locking the decking and the concrete together. Moreover, the use of the relatively closely spaced indentations increases the area of bonding with the concrete (increased shear bond area).

BRIEF DESCRIPTION OF THE DRAWINGS

Numerous other objects, features and advantages of the invention should now become apparent upon a reading of the following detailed description taken in conjunction with the accompanying drawings, and which.

DETAILED DESCRIPTION

Figure 1:
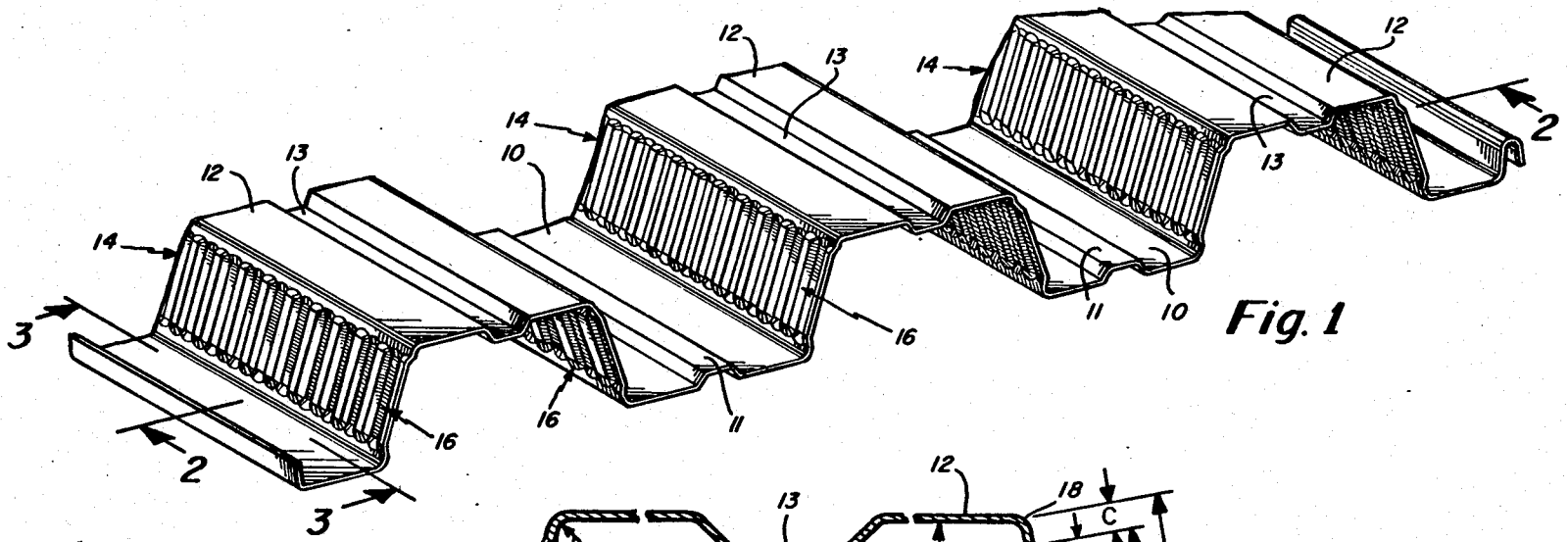
FIG. 1 is a perspective view showing a section of corrugated metal decking employing the web stiffening principles of the present invention.

Referring now to the drawings, there is shown a preferred embodiment of the web stiffening means of the present invention used in association with a corrugated metal flooring. The web stiffening is provided by means of embossments or indentations which serve essentially a dual purpose. These embossments stiffen the web thus preventing web crippling or buckling. Moreover, these embossments by virtue of their orientation and in particular their close spacing provides for a good composite action between the decking and the concrete after the concrete has been poured. The embossments used in this steel deck/reinforced concrete slab composite provide for a locking of the steel deck and the concrete together, thus creating a composite slab. One of the important features that characterizes the stiffening means of the present invention is the substantial strength of the web and also the amount of area that is created by virtue of these closely spaced embossments or indentations thus providing resistance to slipping between the metal decking and the concrete.

Figure 2:
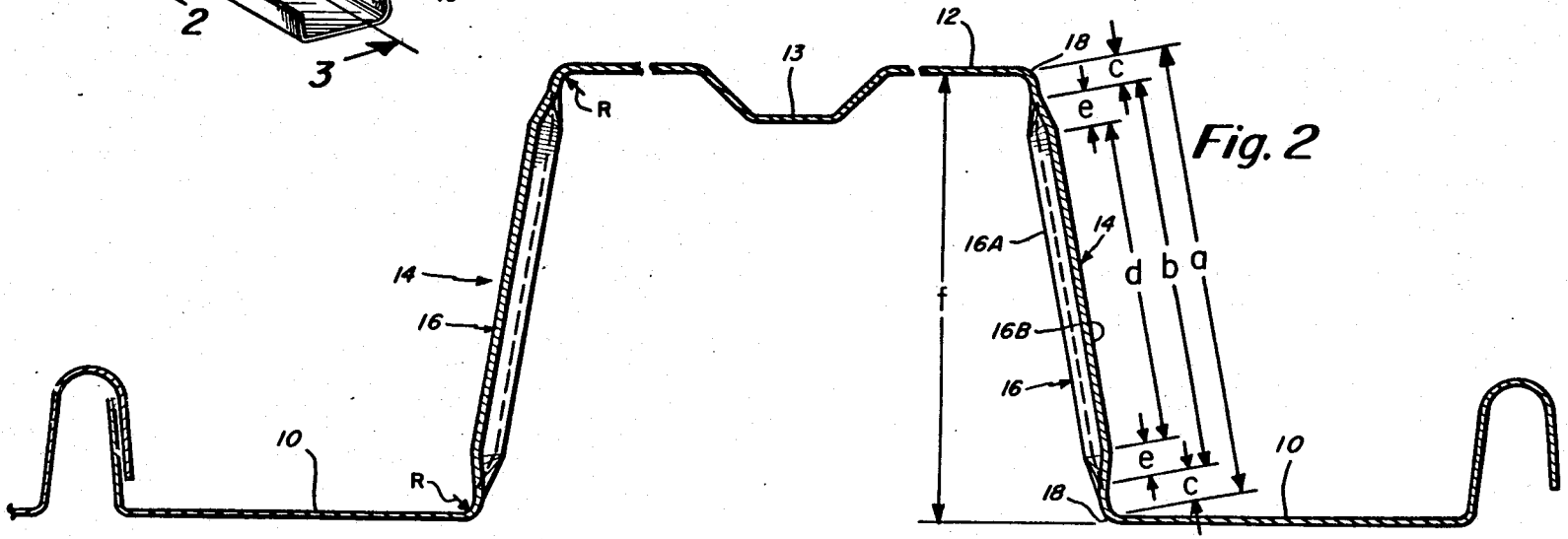
FIG. 2 is a cross-sectional view through the corrugated metal flooring showing the manner in which the embossments or indentations are formed.

Referring now to the drawings, there is shown a corrugated metal decking that is comprised of a series of crests and troughs being made up of trough walls 10 and crest walls 12 with these trough and crest walls being interconnected by webs 14. The trough wall 10 and the crest wall 12 may be provided with respective longitudinal ribs 11 and 13. Each of the webs 14 is of substantially flat configuration before being formed with the indentations or embossments 16. As noted, for example, in FIGS. 2 and 3 these embossments extend almost the entire height of the web 14. The longer that the embossment can be made the more strength will be provided to the web, in particular strength against buckling from loads thereabove. However, it has been found that to maximize the strength the embossment should not extend into the radius areas 18 which are of a radius R as depicted in FIG. 2. These radius areas 18 are defined at the joining point of the web 16 with the crest and trough walls, respectively. Preferred dimensions are described in further detail hereinafter in connection with at least two examples that are provided.

Figure 3:
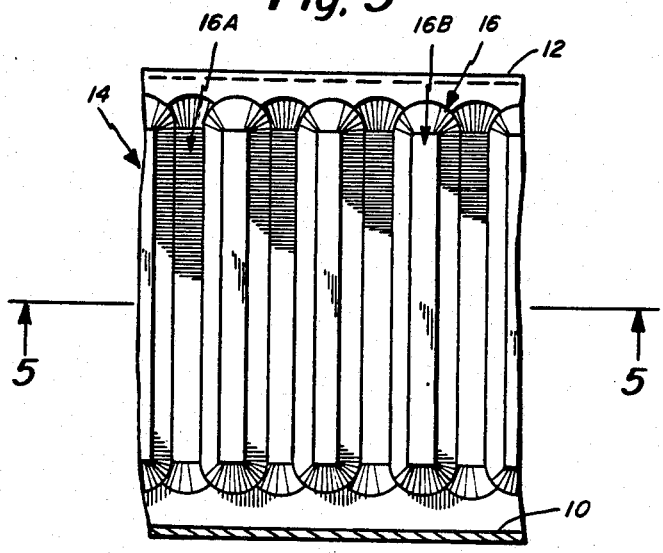
FIG. 3 is a further cross-sectional view taken along line 3—3 and also indicating a side elevation view of the embossments or indentations.
Figure 5:
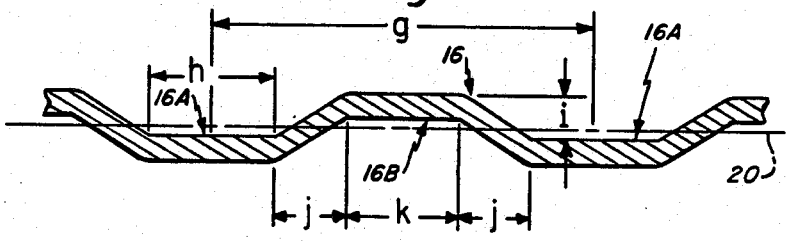
FIG. 5 is a cross-sectional view showing further detail of FIG. 4 and taken along line 5—5 of FIG. 3.

FIGS. 2, 3 and 5 show the construction of the embossments 16. These embossments are formed by a machine that operates so as to provide alternate indentations from embossment to embossment. This is clearly illustrated in, for example, FIG. 5 wherein there is provided outer formed indentations 16A alternating with inner formed indentations 16B. It is noted as depicted in FIG. 5 that the indentations 16A and 16B are both indentations that extend symmetrically from the center line 20. The center line 20 is actually representative of the plane of the web 14 as it appears prior to the indentations being formed. This symmetry is also clearly depicted in FIG. 2. This technique of alternate indentations on a symmetrical basis is advantageous in furthermore optimizing the strength of the stiffened web. If the indentations were provided only in one direction then this would provide an unsymmetrical arrangement that would tend to enhance buckling of the web under load conditions.

In connection with the detail of FIG. 5, it is furthermore noted that the indentations 16A have a greater width than the indentations 16B. This is provided in this manner so as to provide a wider indentation on the concrete side for interlocking purposes. Consideration is given hereinafter to specific examples of many dimensions associated with the embossments.

Figure 4:
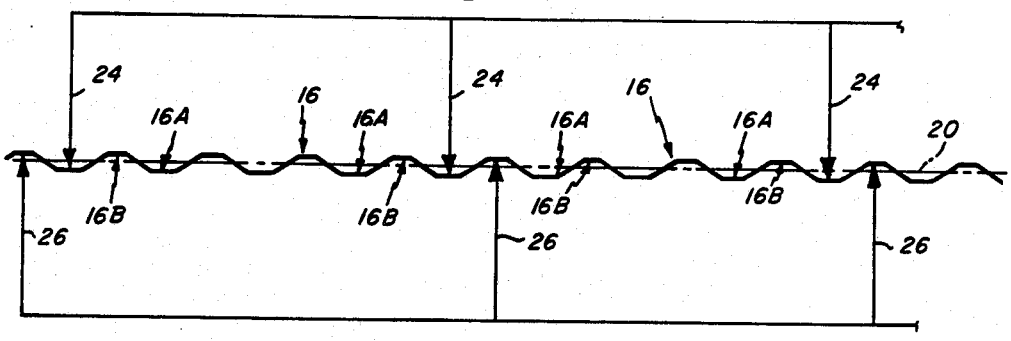
FIG. 4 is a cross-sectional view longitudinally of the corrugated flooring web and schematically illustrating the technique by which alternate inside and outside forming by punching is carried out.

In FIG. 4 there is schematically shown a cross section through the web embossments illustrating the outer formed indentations 16A and the inner formed indentations 16B. FIG. 4 also schematically illustrates by a series of lines the positions at which the indentations are formed for alternate sides of the web. By way of example, this includes outside punch lines 24 and inside punch lines 26. Only three of each of these lines is depicted but this is only for schematic illustration and there is of course a line indicative of a punching operation associated with each of the indentations on opposite sides of the web. FIG. 4 also clearly illustrates the web and center plane or line 20.

It is noted that in FIGS. 2 and 5 that certain predetermined dimensions are set forth. There are now set forth hereinafter two examples of dimensions that may be employed in the present construction and as set forth in the following tables.

TABLE I

| Dimension | Value |
|---|---|
| a | 3.1668" |
| b | 2.8654" |
| c | .1507" |
| d | 2.30" |
| e | .2827" |
| f | 3" |
| g | .545" |
| h | .175" |
| i | .075 |
| j | .105 |
| k | .160 |

TABLE II

| Dimension | Value |
|---|---|
| a | 3.0442" |
| b | 2.6946" |
| c | .1748" |
| d | 2.20" |
| e | .2473" |
| f | |
| g | .545" |
| h | .175" |
| i | .075 |
| j | .105 |
| k | .160 |

As indicated previously, in accordance with the invention, the indentations are provided on an alternating basis so that they are symmetrical about the center line or center plane of the web. Also, the outer formed indentation 16A has a width represented by the dimension (h) that is greater than the width of the inner formed indentation as represented by the dimension (k). This arrangement is provided so as to enhance the interlocking of the concrete to the metal decking. It is also noted from the above examples that the length of the indentation is approximately 75% of the overall height of the web. This is evident in Table I as identified by the dimensions (a) and (d). The dimension (d) of 2.30 inch is approximately 75% of the dimension (a) of 3.1668 inch. The same also applies to the version illustrated by the dimensions in Table II.

Moreover, it has been found that a maximum length of the indentation as represented by the dimension (b) in the above tables, should be in the range of 70%–95% of the overall web height as represented by the dimension (a). Also, as indicated previously, the indentations are not to extend into the radius areas 18, there being a radius on both ends of the web. This means that the web length is dimension (a) that one can then say that the length of the indentation has a maximum value of a−2R. For tolerance purposes, usually this length is less than the above defined amount.

In accordance with the method of instruction of the indentations, it is preferred that the embossing illustrated in FIG. 4 occurs substantially concurrently so that the symmetry is properly maintained.

Also, it is desired to have as close a spacing of the indentations or embossments as possible. It can be seen that from the dimension (g), the embossments repeat at intervals of 0.545 inch. The close spacing of the embossments provides a large area for the concrete to "grab on" to the metal decking, thus providing a strong composite system. As a result of the improved composite action, higher uniform live loads may be sustained by the system. Concentrated and dynamic loads are also better abosrbed by the system due to the improved bond between the metal decking and the concrete.

Having described one embodiment of the present invention, it should now be apparent to those skilled in the art that numerous other embodiments are contemplated as falling within the scope of this invention.

What is claimed is:

1. A corrugated metal decking having alternating crests and troughs and a decking web disposed angularly out of the vertical, a plurality of linear indentations each extending across the decking web in a direction between the crest and trough walls, said indentations being disposed in a parallel array, the length of each indentation being less than the full width of the decking web but extending over a substantial major fraction of the web width, said indentations being provided in contiguous alternating inner and outer formed indentations substantially symmetrical about the web plane, the length of each indentation being in the range of 70% to 95% of the web width, said web being joined to the crest and trough walls by a radius bend, the indentation length being on the order of but less than the dimension a−2R, where a is the web width and R is the radius of the bend and said indentations do not extend into the crest walls, trough walls or radius bends, said outer formed indentations being wider than said inner formed indentations by a ratio on the order of 0.175/0.160.

2. A corrugated metal as set forth in claim 1 wherein the indentations repeat at approximate one-half inch intervals.

3. A corrugated metal decking as set forth in claim 1 wherein the outer formed indentation is wider than the inner formed indentation.

4. A corrugated metal decking as set forth in claim 1 wherein the indentations each have a trapezoidal shape.

5. A corrugated metal decking as set forth in claim 1 wherein the crest and trough each have a longitudinally extending rib.

6. A corrugated metal decking as set forth in claim 1 wherein each of the indentations is of uniform width and is of a width substantially greater than its length.

7. A corrugated metal decking as set forth in claim 1 wherein said decking web full width, dimension a is on the order of 3.1668".

8. A corrugated metal decking as set forth in claim 1 wherein each indentation has a like cross-section along a major intermediate length thereof and tapered opposite end sections joining the major intermediate length to the web width ends, respectively, the maximum indentation length including the major intermediate length and tapered opposite end sections, dimension b, being on the order of 2.8654".

9. A corrugated metal decking as set forth in claim 1 wherein the web width ends each have a width, dimension c, that is on the order of 0.1507".

10. A corrugated metal decking as set forth in claim 1 wherein the major intermediate indentation length, dimension d, is on the order of 2.30".

11. A corrugated metal decking as set forth in claim 1 wherein each tapered opposite end section has a length, dimension e, that is on the order of 0.2827".

12. A corrugated metal decking as set forth in claim 1 wherein the distance measured vertically between crest and trough walls, dimension f, that is on the order of 3".

13. A corrugated metal decking as set forth in claim 1 wherein the spacing between the formal indentations, dimension g, is on the order of 0.545".

14. A corrugated metal decking as set forth in claim 1 wherein the indentations have a trapezoidal cross-section including a center base and sloped sides, said center base of said outer indentation having a width, dimension h, that is on the order of 0.175".

15. A corrugated metal decking as set forth in claim 1 wherein the outer indentations each have a depth, dimension i, that is on the order of 0.075".

16. A corrugated metal decking as set forth in claim 1 wherein each sloped side of the outer indentation has a width, dimension j, that is on the order of 0.105".

17. A corrugated metal decking as set forth in claim 1 wherein the center base of the inner indentation has a width, dimension k, that is on the order of 0.160".

18. In a corrugated metal decking having alternating crests and troughs and interconnecting therebetween a decking web disposed angularly out of the vertical, a method of stiffening the decking web comprising the steps of providing a plurality of linear indentations, each extending across the decking web in a direction between the crest and trough walls, disposing the indentations in a parallel array with the length of each indentation being less than the full width of the decking web but extending over a substantial major fraction of the web width, and providing the indentations in contiguous alternating inner and outer formed indentations substantially symmetrical about the web plane the length of each indentation being in the range of 70% to 95% of the web width, said web being joined to the crest and trough walls by a radius bend, the indentation length being on the order of but less than the dimension a−2R, where a is the web width and R is the radius of the bend and said indentations do not extend into the crest walls, trough walls or radius bends, said outer formed indentations being wider than said inner formed indentations by a ratio on the order of 0.175/0.160.

19. A corrugated metal decking as set forth in claim 18 wherein said decking web full width, dimension a, is on the order of 3.0442".

20. A corrugated metal decking as set forth in claim 18 wherein each indentation has a like cross-section along a major intermediate length thereof and tapered opposite end sections joining the major intermediate length to the web width ends, respectively, the maximum indentation length including the major intermediate length and tapered opposite end sections, dimension b, being on the order of 2.6946".

21. A corrugated metal decking as set forth in claim 18 wherein the web width ends each have a width, dimension c, that is on the order of 0.1748".

22. A corrugated metal decking as set forth in claim 18 wherein the major intermediate indentation length, dimension d, is on the order of 2.20".

23. A corrugated metal decking as set forth in claim wherein each tapered opposite end section has a length, dimension e, that is on the order of 0.2473".

24. A corrugated metal decking as set forth in claim 18 wherein the spacing between the formal indentations, dimension g, is on the order of 0.545".

25. A corrugated metal decking as set forth in claim 18 wherein the indentations have a trapezoidal cross-section including a center base and sloped sides, said center base of said outer indentation having a width, dimension h, that is on the order of 0.175".

26. A corrugated metal decking as set forth in claim 18 wherein the outer indentations each have a depth, dimension i, that is on the order of 0.075".

27. A corrugated metal decking as set forth in claim 18 wherein each sloped side of the outer indentation has a width, dimension j, that is on the order of 0.105".

28. A corrugated metal decking as set forth in claim 18 wherein the center base of the inner indentation has a width, dimension k, that is on the order of 0.160".

* * * * *